United States Patent [19]

Schoenhard

[11] Patent Number: 4,571,120

[45] Date of Patent: Feb. 18, 1986

[54] ROAD LEVELLING OIL SQUEEGEE

[75] Inventor: James D. Schoenhard, Morrison, Ill.

[73] Assignee: International Technology Services, Morrison, Ill.

[21] Appl. No.: 689,331

[22] Filed: Jan. 7, 1985

[51] Int. Cl.[4] ..... E01C 19/16

[52] U.S. Cl. ..... 404/101; 404/118; 15/245; 118/100; 427/138

[58] Field of Search ..... 404/75, 78, 86, 96, 404/101, 108, 111, 118; 15/245; 118/100, 108; 427/136, 138, 139

[56] References Cited

U.S. PATENT DOCUMENTS

| | | | |
|---|---|---|---|
| 2,787,876 | 4/1957 | Cole | 404/101 |
| 3,415,173 | 12/1968 | Paul | 404/118 |
| 3,559,543 | 2/1971 | Schwoebel | 404/101 |
| 3,685,404 | 8/1972 | Rich et al. | 404/118 X |
| 4,302,128 | 11/1981 | Thatcher | 404/111 |

FOREIGN PATENT DOCUMENTS

| | | | |
|---|---|---|---|
| 308423 | 3/1929 | United Kingdom | 404/101 |

*Primary Examiner*—Stephen J. Novosad
*Assistant Examiner*—John F. Letchford
*Attorney, Agent, or Firm*—Cook, Wetzel & Egan, Ltd.

[57] ABSTRACT

An oil-spreading squeegee for roadway maintenance uniformly spreads oil sprayed onto a roadway surface to be maintained or upgraded. The squeegee assures a surprisingly uniform surface, particularly by filling cracks and moderate depressions in the roadway surface not filled by mere levelling of the liquid oil after a spraying operation alone. The squeegee is towed behind the oil spraying truck, extending across the roadway surface and being maintained on rollers a selected height above the existing pavement. The squeegee pools the oil ahead of its blade while forming a uniform coating on the roadway surface over which the blade has passed. The pool of oil fills cracks and moderate depressions in the roadway surface directly, and thus avoids loss of uniformity in the height of the top of the oil coating. Aggregate is then spread over the roadway and tamped or rolled into the oil, which hardens about the aggregate to form a new, smooth roadway surface.

2 Claims, 4 Drawing Figures

ROAD LEVELLING OIL SQUEEGEE

The present invention relates to roadway maintenance equipment, and relates particularly to apparatus for distributing oil upon a roadway surface as part of a roadway maintenance and resurfacing operation.

In conventional roadway resurfacing operations, involving moderate-speed secondary and rural roads with built-up aggregate pavement, resurfacing is periodically done by applying a layer of oil or low-viscosity tar to the existing roadway surface. The oil is allowed to distribute itself over the surface and to level itself by flow under the force of gravity and surface tension alone. After a short time interval, sand or aggregate is spread onto the oil surface and tamped into the oil coating, so that the aggregate permeates and is bound to the existing road surface by the oil. The new surface then is immediately ready for highway traffic.

The known prior art road resurfacing system suffers from several defects. First, although a uniform spray of oil can be applied to a roadway, accomodation is not made for existing cracks, depressions and high points in the existing pavement. Rather, the oil is left simply to find its own level during the time between liquid application and spreading of aggregate. A sizeable crack or moderate depression in the existing roadway surface will leave a low spot in the oil and thus in the new highway surface, subject only to such levelling as may occur by gravity.

Second, differences in the application rate of the oil across the roadway surface will cause variations in the depth of the resulting new surface.

Third, because of the above defects, prepreparation of the existing roadway surface and maintenance of the spray nozzle system is critical to successful resurfacing.

The present invention avoids the above objections and deficiencies. The present invention provides for a method and apparatus by which oil sprayed onto the road surface is pooled and distributed by a squeegee blade extending across the roadway surface. The squeegee comprises a broad, flexible blade extending across the roadway surface and maintained a short distance above the pre-existing roadway surface, equal to the depth of finished oil film desired. The height of the blade above the surface is adjustably controlled, as by a hydraulic actuator operating between the support member for the squeegee and a wheeled truck engaging the oil-coated surface. Outward end members of the squeegee are pivotable forwardly as "wings" to reduce the effective width of the squeegee across the road surface and also to aid in the pooling of oil forwardly of the squeegee blade. The squeegee support structure includes an adjusting lever for maintaining the squeegee blade in a vertical position with respect to the roadway despite variations in vertical mounting position of the draw bars on the towing vehicle.

Figure 1:
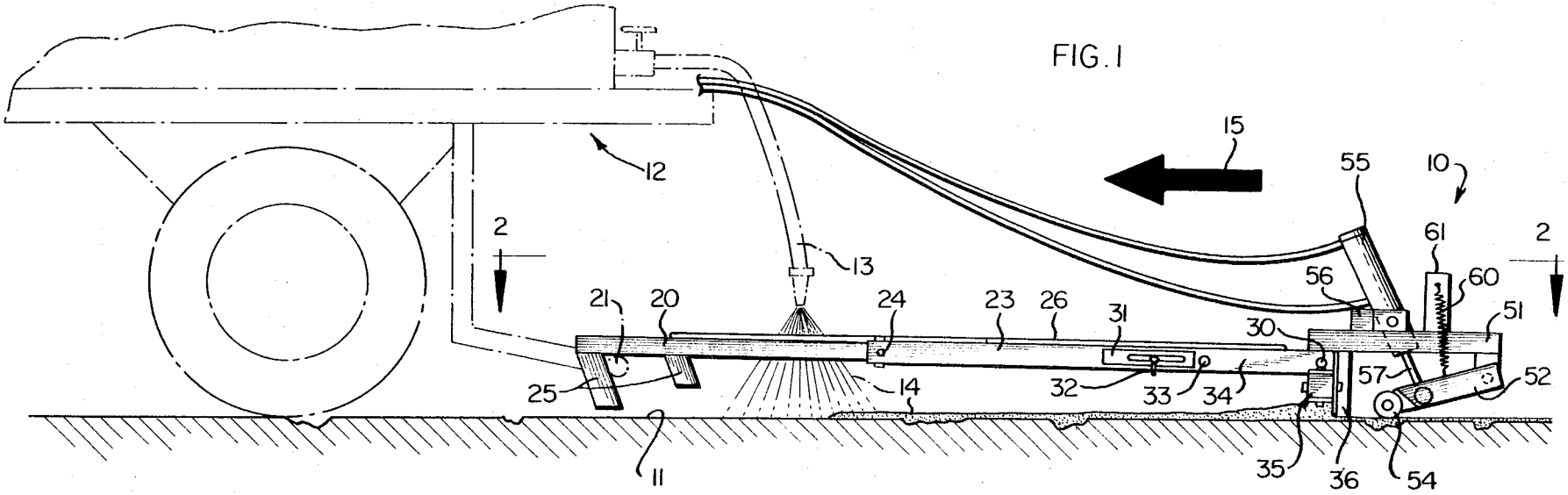
FIG. 1 is a side elevational view, partly in section, of the road levelling oil squeegee of the present invention, shown in operation on a roadway surface, with the towing, oil-application truck shown in phantom.

A road levelling oil squeegee in accordance with the principles of the present invention is shown in one embodiment in the drawing figures at 10. FIG. 1 shows the squeegee in use on a roadway surface 11, being pulled behind an oil distribution truck 12, shown in phantom, having a downwardly-directed oil spray bar 13. Oil 14 is deposited on the road surface 11 from the spray bar 13 while the truck 12 moves at a few miles per hour in a forwardly direction (shown by the arrow 15) so that a desired thickness of oil will, on average, be applied to the roadway surface. Such desired thickness will depend on the nature and condition of the pre-existing roadway surface 11; a smooth surface in good condition usually would require a less-thick coating than an aggregate surface or one in poor condition. Generally, however, a coating about $\frac{1}{8}$ to $\frac{1}{4}$ inch in average thickness is useful for most conditions.

Figure 2:
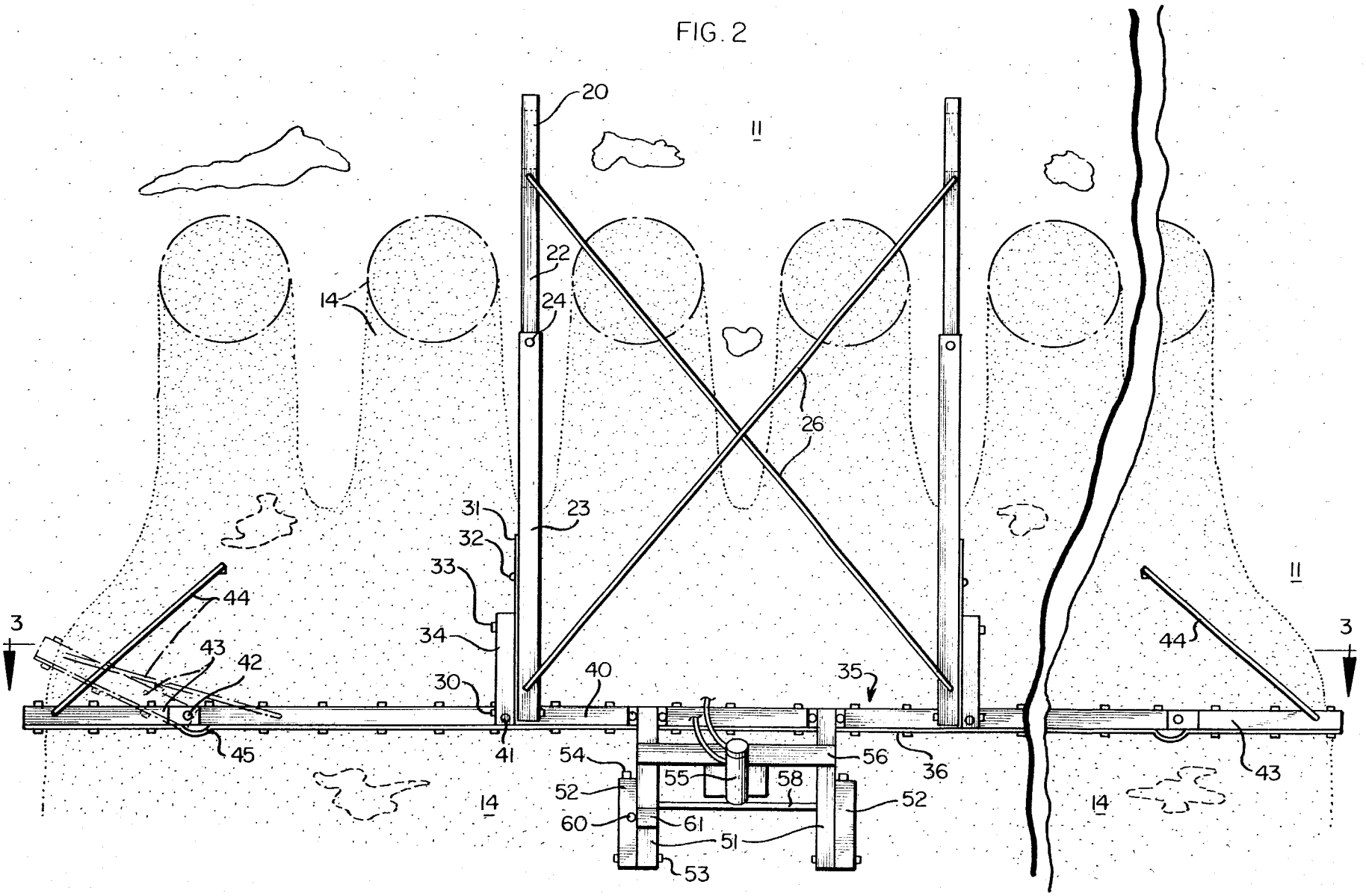
FIG. 2 is a top view, on line 2—2 of FIG. 1, of the road levelling oil squeegee of the invention, with one of the wings shown in phantom in a forwardly-adjusted position.

The oil squeegee 10 comprises first a pair of draw bars 20 as shown in FIGS. 1 and 2, extending along the roadway surface 11 and engaging with a hook structure 21 on the truck 12. The draw bars 20 are of any desirable length, and indeed may be made adjustable in length by using first and second portions 22, 23, with a bolt or pin connector 24 between them. The draw bars 20 as well as other components of the oil squeegee 10 are advantageously constructed of rectangular tubing having regular perforations on each side for receiving bolts, such as those made by GTE Company under the "Telespar" trademark. In one embodiment, the rearward portion 23 is about $3\frac{1}{2}$ feet long, and the forward portion 22 extends another $2\frac{1}{2}$ to 3 feet forwardly of the connector 24. Hitching members 25 are provided at the front end of the draw bars 20, for easy connection to the hook or bar 21 on the truck 12. In addition, stabilizer bars 26 are provided in an "X" arrangement between forward and rearward ends of the pairs of draw bars 20, as shown in FIG. 2. These stabilizer bars 26 comprise, for instance, $\frac{3}{8}$ inch steel rods having ends turned 90° and inserted into the perforations in the rectangular tubing.

Figure 4:
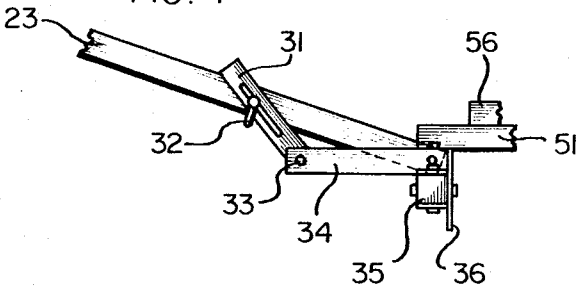
FIG. 4 is a side elevational view of a portion of the draw bar portion of the invention, showing the draw bar in a raised position to fit a different towing vehicle.

Rearward ends of the draw bar portions 23 carry horizontal pivot pins 30. Tilt adjusting levers 31 are carried in a slide joint on levers or bolts 32 forwardly of the pivot pins 30. Rearward ends of the tilt levers 31 carry further pivot bolts 33. The pivot pins 30 and bolts 33 engage opposite ends of stub shafts 34 which are fixedly connected to a perpendicular, horizontally-extending main support beam 35 on which is carried a squeegee blade or pad 36, as shown in FIGS. 1 and 2. The above structure is shown in some detail in FIG. 4.

The horizontal support beam 35 comprises a center bar 40 extending about 10 feet across the roadway surface 11. Center bar 40 of the support beam 35 is firmly connected to the stub shafts 34 by bolt connections 41. Each outward end of the center bar 40 is formed to accept a vertical pivot pin 42. The forward and rearward portions of such ends of the bar 40 are removed and the upper and lower portions are spread apart to accept inward ends of outward end bars 43. Stop means (not shown) are included to prevent the end bars 43 from rotating behind the center bar 40.

The pivot connections at pins 42 permit the outward end bars 43 to pivot forwardly, as shown in phantom at the left side of FIG. 2. Such pivoting reduces the effective working width of the support beam 35 and of the squeegee 10 for use on narrower roadways. Such pivoting also increases the pool capacity of the oil squeegee 10, because oil is hindered from flowing sidewardly around the outward ends of the squeegee blade 36, but must flow forwardly too. Locking bars 44 are provided to adjustably fix the desired angle of forward sweep between each outward end bar 43 and the center bar 40 of the squeegee support beam 35.

Affixed to the rear of the support beam 35 is the squeegee blade or pad 36. This blade 36 preferably comprises a moderately flexible rubber pad, approximately 6 inches high and ½ inch thick in one embodiment. The squeegee blade 36 is bolted to the support beam 35 about every 6 inches in the disclosed embodiment, although other support arrangements such as capture between a pair of rigid beams could be used. Portions of the squeegee blade 36 form rearwardly-extending, partial loops 45 at the junctures of the center bar 40 and the outer bars 43 of the support beam 35. Such loops 45 are necessary in the embodiment shown in order that the blade or pad 36 not be stretched or torn as the outward portions 43 are pivoted forwardly. The loops 45 include enough additional length of material so that the loop 45 will be drawn tight only at a maximum, 90° pivoting of the outer end bar 43 with respect to the center bar 40. Use of a continuous, partly looped portion 45 prevents loss of oil from the pool forwardly of the squeegee blade 36 through a gap at the pivot points 42. Other sealing means could alternatively be used.

Figure 3:
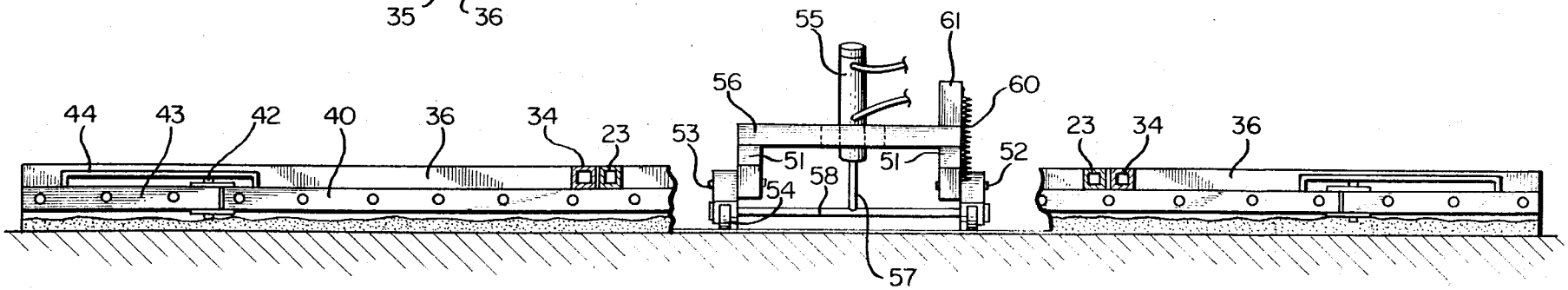
FIG. 3 is a rearward view on line 3—3 of FIG. 2, from just in front of the support means for the squeegee blade.

Supporting the support beam 35 and the squeegee blade or pad 36 above the roadway surface 11 is a carrier and height adjustment assembly 50, shown in each of the FIGS. 1, 2, and 3. The carrier and height adjustment assembly 50 comprises first a pair of fore-and-aft stringers 51 bolted onto spacers at their forward ends and to the center bar 40 of beam 36. Rearward ends of the stringers 51 carry wheeled strut members 52, connected at their rearward ends at horizontal pivot pins 53. Forward, lower ends of the struts 52 carry supporting members such as castored wheels 54 for engaging the road surface 11 and/or the coating of oil 14 emerging from beneath the squeegee blade 36 in operation. In a preferred embodiment as shown, the support members 54 are castored wheels, which can quickly pivot to follow turning motions of the truck 12 in maneuvering into position for spraying operations and the like.

The height of the support bar 35 and squeegee blade or pad 36 above the road surface 11 is carefully controlled by the angle between the stringers 51 and the struts 52. That angle is governed by a pneumatic cylinder or similar device 55 carried on a cross member 56 extending between and connecting the stringers 51. The casing of the cylinder 55 is pivotally connected to the cross piece 56. A plunger 57 of the cylinder 55 engages an axle bar 58 extending between the two struts 52. Pneumatic actuation of the cylinder 55 extends or retracts the plunger 57, increasing or decreasing the angle of the struts 52 and thereby raising or lowering the support beam 35 and the squeegee blade 36 with respect to the road surface 11. The pneumatic cylinder 55 can be a double-acting cylinder, both raising and lowering the assembly with respect to the road surface 11. Alternatively, if a single-acting, raising cylinder is provided, a powerful spring 60 will lower the assembly by applying tension between a bracket member 61 carried on one of the stringers 51 and its respective strut 52. Other arrangements may also be devised, or both the spring 60 and the double acting cylinder can be employed, for ease in operation.

The road levelling oil squeegee assembly 10 is extremely easy and reliable to use. Connected as shown in FIG. 1, the squeegee assembly 10 is towed behind a truck 12 which dispenses oil through a horizontally-arrayed spray bar 13 or or the like onto the road surface 11. The oil 14 coats and spreads out on the road surface 11, and begins to fill cracks and depressions in the surface of the roadway 11. The squeegee blade 36 is drawn behind the truck 12 and behind the spray nozzles 13. A pool of oil is collected forward of the blade 36 which is deeper than the final oil coating depth desired. The pool carried ahead of the squeegee blade 36 assures that moderate depressions, cracks and the like are filled from the oil 14 sprayed onto the surface of the road 11, even over extensive cracks and depressions. Indeed, the flow of oil from selected nozzles 13 is most desirably made quickly variable, either automatically or by manual control. Variables such as the particular condition of the road surface 11 immediately ahead of the nozzles 13, the depth of the pool of oil immediately ahead of the squeegee blade 36, and the like, can be employed to adjust the amount of oil applied to make use of the squeegee most effective. Extensive corrections to the quality of the road surface 11 can thus be achieved. The key is to prevent the rearward edge of the pool of oil carried ahead of the squeegee blade 36 from dropping, due to filling of cracks and depressions, below the lower edge of the blade 36. Then the coating of oil on the surface 11 will not be uniform rearwardly of the squeegee 36, and the problems presented by the prior art system will recur.

Numerous minor modifications in the embodiment shown will occur to those having skill in the road construction and maintenance art. The one form of the invention disclosed is merely illustrative, and the scope of the invention is to be limited only by the terms of the appended claims.

I claim as my invention:

1. A road-levelling oil squeegee adapted for trailing behind a moving vehicle which distributes oil onto a roadway surface, for pooling oil to fill cracks and depressions in a roadway surface prior to spreading aggregate onto and tamping said aggregate into said oil to maintain and upgrade said roadway surface, the squeegee comprising:

an elongate, flexible blade means extending across said roadway surface and having a lower edge portion for engaging said oil forwardly thereof in said direction of motion, and for providing a level surface to said oil rearwardly of said blade;

support means for supporting and rigidifying said blade means vertically and horizontally except along said lower edge portion, where said blade means remains unsupported and flexible, the support means comprising a center portion having sideward ends and a pair of opposed, outer end portions, each of said outer end portions being pivotally connected to said center portion at said sideward ends thereof, whereby to allow adjustment of the effective width of the squeegee across the road surface and to entrap oil otherwise flowing sidewardly of the blade means from its center;

height adjustment means for engaging the roadway surface and carrying said blade means at any selected height above said roadway surface; and drawing means for connecting said support means to said vehicle;

wherein the blade means further has rearwardly extended, partly looped means at each pivot connection for enabling said outer end portions to swivel forwardly and for blocking any excess flow of oil past said pivot connection.

2. A road-levelling oil squeegee adapted for trailing behind a moving vehicle which distributes oil onto a roadway surface, for pooling oil to fill cracks and depressions in a roadway surface prior to spreading aggregate onto and tamping said aggregate into said oil to maintain and upgrade said roadway surface, the squeegee comprising:

an elongate, flexible blade means extending across said roadway surface and having a lower edge portion for engaging said oil forwardly thereof in said direction of motion, and for providing a level surface to said oil rearwardly of said blade;

support means for supporting and rigidifying said blade means vertically and horizontally except along said lower edge portion, where said blade means remains unsupported and flexible;

said support means comprising a center portion having sideward ends and a pair of opposed, outer end portions, each of said outer end portions being pivotally connected to said center portion at the sideward ends thereof;

wherein the blade means further has rearwardly extended, partly looped means at each pivot connection for enabling said outer end portions to swivel forwardly and for blocking any excess flow of oil past said pivot connection;

height adjustment means for engaging the roadway surface and carrying said blade means at any selected height above said roadway surface; and drawing means for connecting said support means to said vehicle, the drawing means having a forward end for attachment to said vehicle at any selected height above said roadway surface;

wherein the support means is pivotally connected to the drawing means on a single, sidwwardly-extending, horizontal axis; and wherein the drawing means and support means further comprise tilt control means for adjustably tilting the blade means about said horizontal axis to maintain said blade means normal to said roadway surface despite variations in the height of attachment of the forward end of the drawing means to said vehicle.

* * * * *